US006325459B1

(12) United States Patent
Jaeger et al.

(10) Patent No.: US 6,325,459 B1
(45) Date of Patent: Dec. 4, 2001

(54) CONCRETE BREAKER HEAD

(76) Inventors: Donald J. Jaeger, 2025 Theisen St., Dubuque, IA (US) 52001-5666; Kenneth W. Jaeger, 10359 Bolenyn Rd., Dubuque, IA (US) 52001

( * ) Notice: Subject to any disclaimer, the term of this patent is extended or adjusted under 35 U.S.C. 154(b) by 0 days.

(21) Appl. No.: 09/464,752

(22) Filed: Dec. 16, 1999

(51) Int. Cl.[7] ..... E01C 23/12
(52) U.S. Cl. ..... 299/37.3; 173/100
(58) Field of Search ..... 299/69, 36.1, 37.1, 299/37.2, 38.1, 37.3, 37.4, 37.5, 100; 404/83, 85, 86, 90, 133.2; 37/403; 414/912; 172/245, 247, 253; 173/184, 185, 100, 94, 89, 211

(56) References Cited

U.S. PATENT DOCUMENTS

| | | | | |
|---|---|---|---|---|
| D. 252,461 | | 7/1979 | Korpi . | |
| 1,250,521 | | 12/1917 | Schumacher . | |
| 1,521,327 | | 12/1924 | Schumacher . | |
| 2,029,363 | | 2/1936 | Downie . | |
| 2,529,892 | | 11/1950 | Adams . | |
| 2,688,233 | | 9/1954 | Craig et al. . | |
| 3,091,159 | | 5/1963 | Miller . | |
| 4,457,645 | | 7/1984 | Klochko . | |
| 4,984,639 | * | 1/1991 | Lindsey et al. | 173/100 |
| 5,234,282 | | 8/1993 | Osborne . | |
| 5,393,127 | * | 2/1995 | Kimball, II | 299/37.4 |
| 5,662,385 | | 9/1997 | Bishop . | |
| 5,755,048 | | 5/1998 | Lee . | |

FOREIGN PATENT DOCUMENTS

| | | |
|---|---|---|
| 2028902 | 3/1980 | (GB) . |
| 5009908 | 1/1993 | (JP) . |

* cited by examiner

*Primary Examiner*—David Bagnell
*Assistant Examiner*—Sunil Singh
(74) *Attorney, Agent, or Firm*—Richard C. Litman

(57) ABSTRACT

An improved concrete breaker head for attachment to skid loaders via releasable latches having a counterbalanced hammer member, an impact support member and an attachment face-plate for attaching a skid loader and for subsequent articulation. The counterbalance hammer member has a tubular support housing with a first and a second end. A counter-weighting metal element is used for stabilizing and balancing the moment of inertia of the hammer about a pivoting axis of rotation. An impact head portion is disposed on the first end of the tubular housing, and includes the attachment of a tubular support arm structure integrally disposed near the second end of the housing in orthogonal arrangement with the housing. This particular configuration serves to uniformly distribute occurrences of localized impact stresses therethrough which extends the life or cyclical use of the hammer over time. The tubular supporting arm structure is pivotally and integrally attached to the face-plate and the impact support member which allows for raising and lowering the hammer member via free-fall or the force of gravity. A dual damper assembly is used to reduce mechanical vibrations throughout the hammer head member.

19 Claims, 3 Drawing Sheets

CONCRETE BREAKER HEAD

BACKGROUND OF THE INVENTION

1. Filed of the Invention

The present invention relates generally to a mechanical hammer for industrial applications. More specifically, the invention is an improved concrete and/or pavement breaking apparatus adaptable for attachment to skid loaders.

2. Description of the Related Art

A variety of devices have been devised for demolition activity related to cutting and/or pounding pavement or concrete. These devices have also been used for inserting posts of various sorts where human effort alone has been found insufficient for achieving the magnitude of forces required to accomplish particular objectives, particularly, required for removal of concrete or similar material. The difficulty with most of the conventional devices for asphalt, concrete or pavement removal found in the prior art is that such devices are either complex machinery having gears and pulleys as moveable mechanical elements which constantly requires repairs from cyclical or long term use. As with the conventional devices modern, apparatus for breaking apparatus are limited in mobility and use and are permenently fixed to vehicle with added difficulty for transport. An improved concrete breaker which is resistant to cyclical stresses and/or material fatigue and has minimized mechanical parts for quick and easy mechanical connections and transport as herein described is lacking in the prior and currently related demolition devices.

For example, Patents issued to Schumacher (U.S. Pat Nos. 1,250,521 and 1,521,327), Lee (U.S. Pat. No. 5,755,048) and Fujinawa(JP 59908) disclose asphalt and concrete drilling or cutting apparatuses which are operated via complex gear and pulley systems with some automation. The cutting heads disclosed, particularly in the first three aforementioned patents, are mechanically and permanently fixed and resembles the shape of conventional back hoes. The patent issued to Fujinawa, however, discloses a concrete drill robot having a single drill bit disposed within a articulated arm run by a battery powered controller as a position controlled hammer drill. Drill bits have the tendency to fracture and are known for indirectly inflicting injury due to flying debris. These devices subsequently require vacuums or power fans considered unnecessary and superfluous by the concrete breaker as herein described.

U.S. Patents which disclose mechanical hammers of similar conventional construction are those issued to Downie (U.S. Pat. No. 2,029,363), Adams (U.S. Pat. No. 2,529,892), Craig et al. (U.S. Pat. No. 2,688,233) and Miller (U.S. Pat. No. 3,091,159). These systems are pulley based systems which include multiple connection to a control cabin of heavy duty tractors. The hammer heads are mechanically secured via mechanical fasteners and are not shaped an form as a single entity. In most excavating mechinery, various adaptor heads are used in the related industry including those having the ornamental design as shown in the U.S. Design Pat. No. 252,461 issued to Korpi.

More recently, ground breaking apparatuses disclosed by Klochko (U.S. Pat. No. 4,457,645), Osborn (U.S. Pat. No. 5,234,282), Bishop (U.S. Pat. No. 5,662,385) and Spence (GB 2028902) have been devised which approach the concrete breaker as herein described or have semblance thereof, but are significantly different. The patent issued to Bishop discloses a hammer for demolishing sidewalks and the like which has a single solid circular head attached to a plurality of metal support strips of varying lengths and are fastened together at an opposite end via a nut and bolt fastener assembly. The Patent issued to Klochko discloses a similar apparatus which utilizes a plurality of mechanically fastened strips for supporting a single solid cylindrical hammer head for breaking pavement. The arm is manipulated via dual purpose jack lift and truck transportation vehicle.

The patent issued to Osborn appears to have features similar to the concrete breaker as herein described, however, this hammer absorbs impact as a localized concentration at the head of the hammer, which unfortunately results in material fatigue or fracture from cyclical stresses. Another contributing factor to material fatigue is due to the structural shape or configuration of the hammer head. The concrete head according to the instant invention has an asymmetrical construction which uniformly distributes stresses without material fatigue related to localized stress concentrations. Another significant difference is there are no dampers used to minimize mechanical vibrations within the hammer as herein described.

None of the above inventions and patents, taken either singularly or in combination, is seen to describe the instant invention as claimed. Thus, a concrete breaker head solving the aforementioned problems is desired.

SUMMARY OF THE INVENTION

The improved concrete breaker head for attachment to skid loaders via releasable latches according to the invention includes a counterbalanced hammer member, an impact support member and an attachment face-plate for attaching a skid loader thereto. The counterbalance hammer member has a tubular support housing with a first and a second end. A counter-weighting metal element is used for stabilizing and balancing the moment of inertia of the hammer about a pivoting axis of rotation. An impact head portion is on the first end of the tubular housing, including the attachment of a tubular supporting arm structure integrally disposed near the second end of the housing in substantially orthogonal arrangement with a side portion of the housing. This particular configuration uniformly distributes localized impact stresses therethrough and extends the life or cyclical use of the hammer over time.

The tubular supporting arm structure is pivotally and integrally attached to the face-plate and the impact support member which allows for raising and lowering the hammer member via free-fall or the force of gravity. Mechanical vibrations are absorbed within the structure of the impact member in part via a first and second combination damping and constraining coil and cable, respectively. The concrete breaker provides a single quick and easy face-plate attachment to a skid loader with minimized mechanical fasteners.

Accordingly, it is a principal object of the invention to provide an improved concrete breaker head for breaking concrete, pavement, and/or to the lesser extent asphalt.

It is another object of the invention to provide an improved concrete breaker head which is impervious to material fatigue related to cyclical stresses.

It is a further object of the invention to provide an improved concrete breaker head which significantly reduces mechanical vibrations related to localized stress concentrations throughout the structure of the concrete breaker.

Still another object of the invention is to provide an improved concrete breaker head having reduced material requirements and mechanical fasteners.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an improved concrete and/or breaker adapted with a face-plate for attachment to skid loaders with hydraullically controlled latches. The preferred embodiment of the present invention is depicted in FIGS. 1–3, and is generally referenced by numeral 4.

Figure 1:
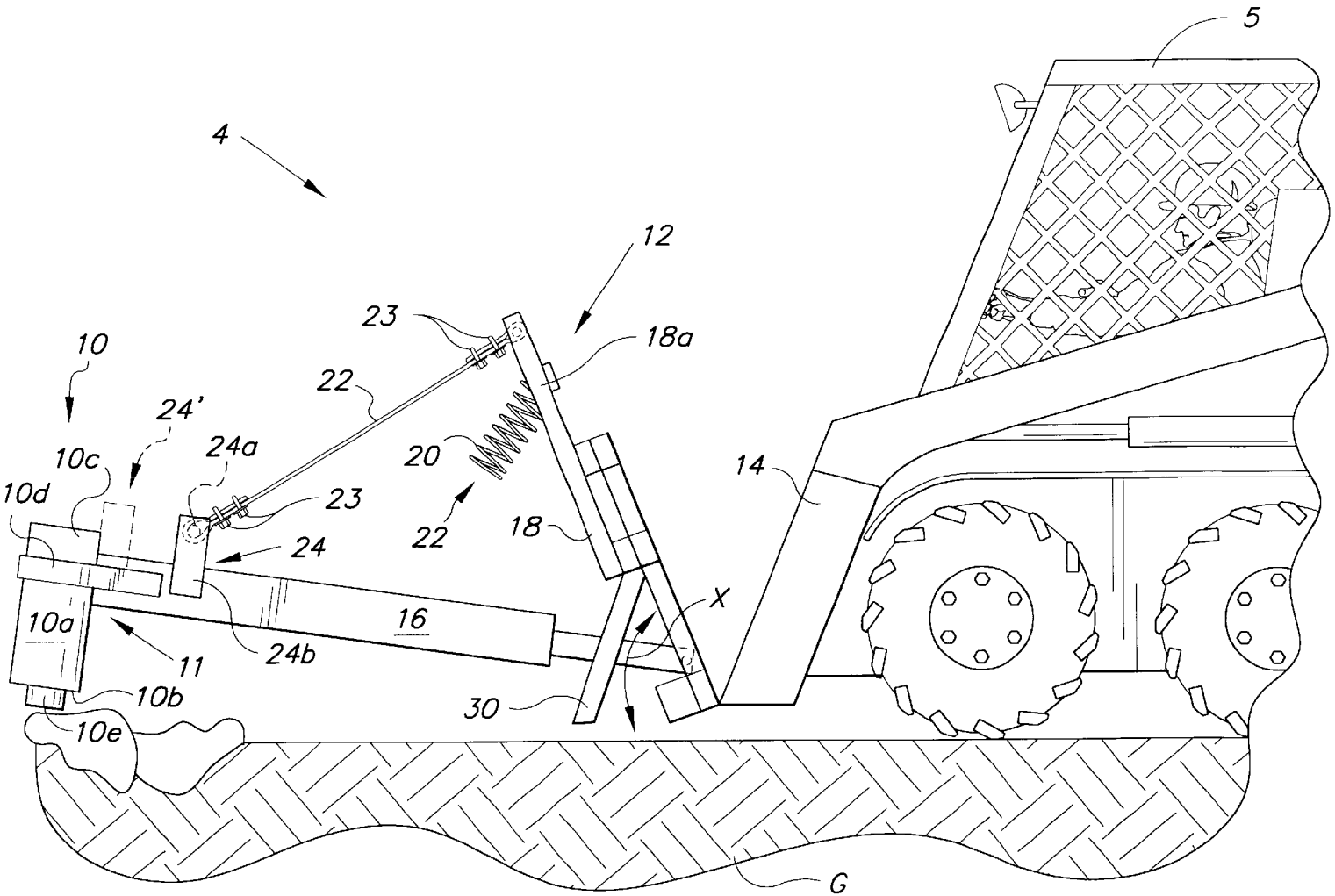
FIG. 1 is an environmental, perspective view of a concrete breaker head according to the present invention, illustrating the breaker head in combination with a skid loader in a concrete impact mode.
Figure 2:
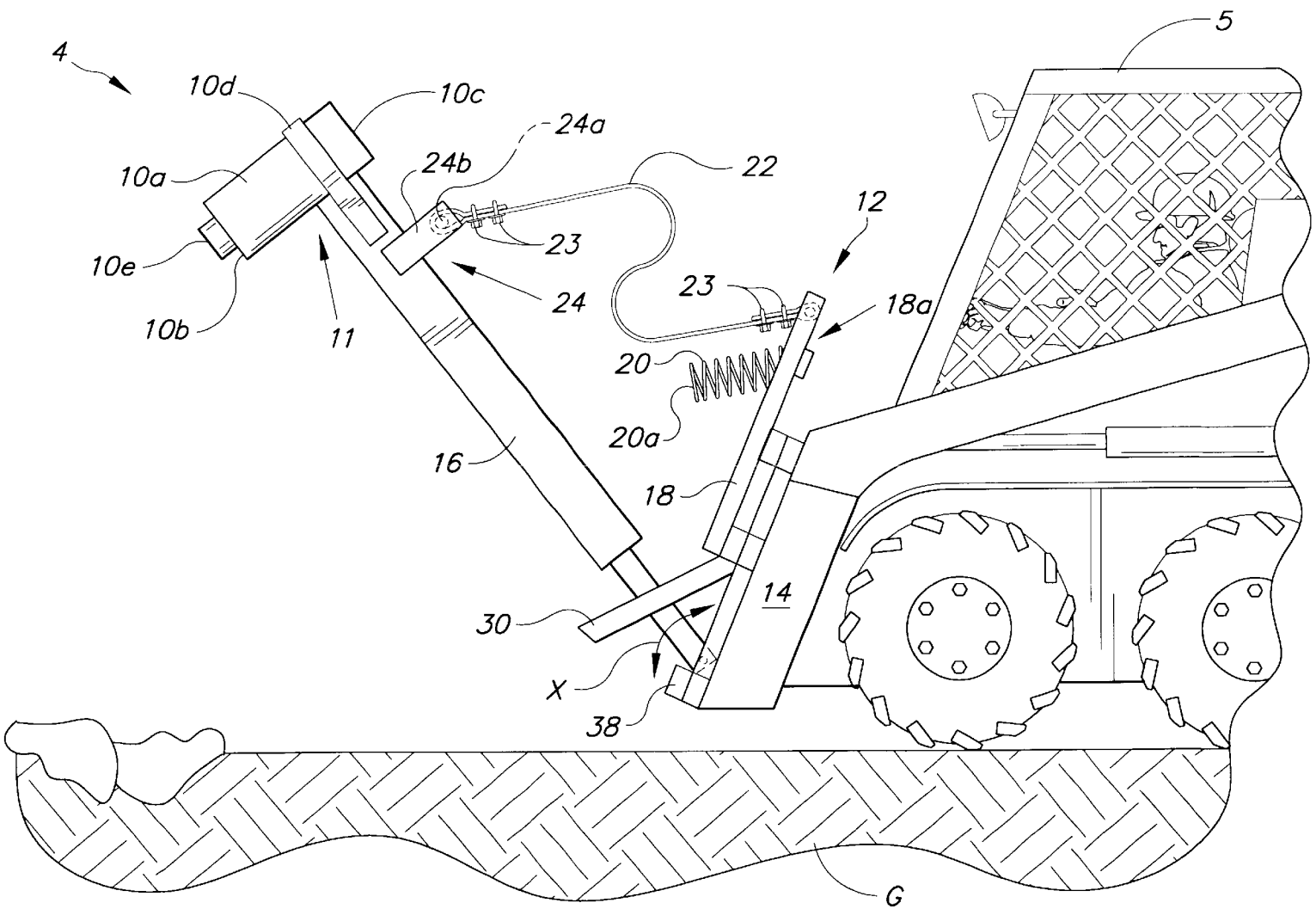
FIG. 2 is an environmental perspective view of the concrete breaker head according to the invention, illustrating the breaker head in an elevated position for free-fall impact.
Figure 3:
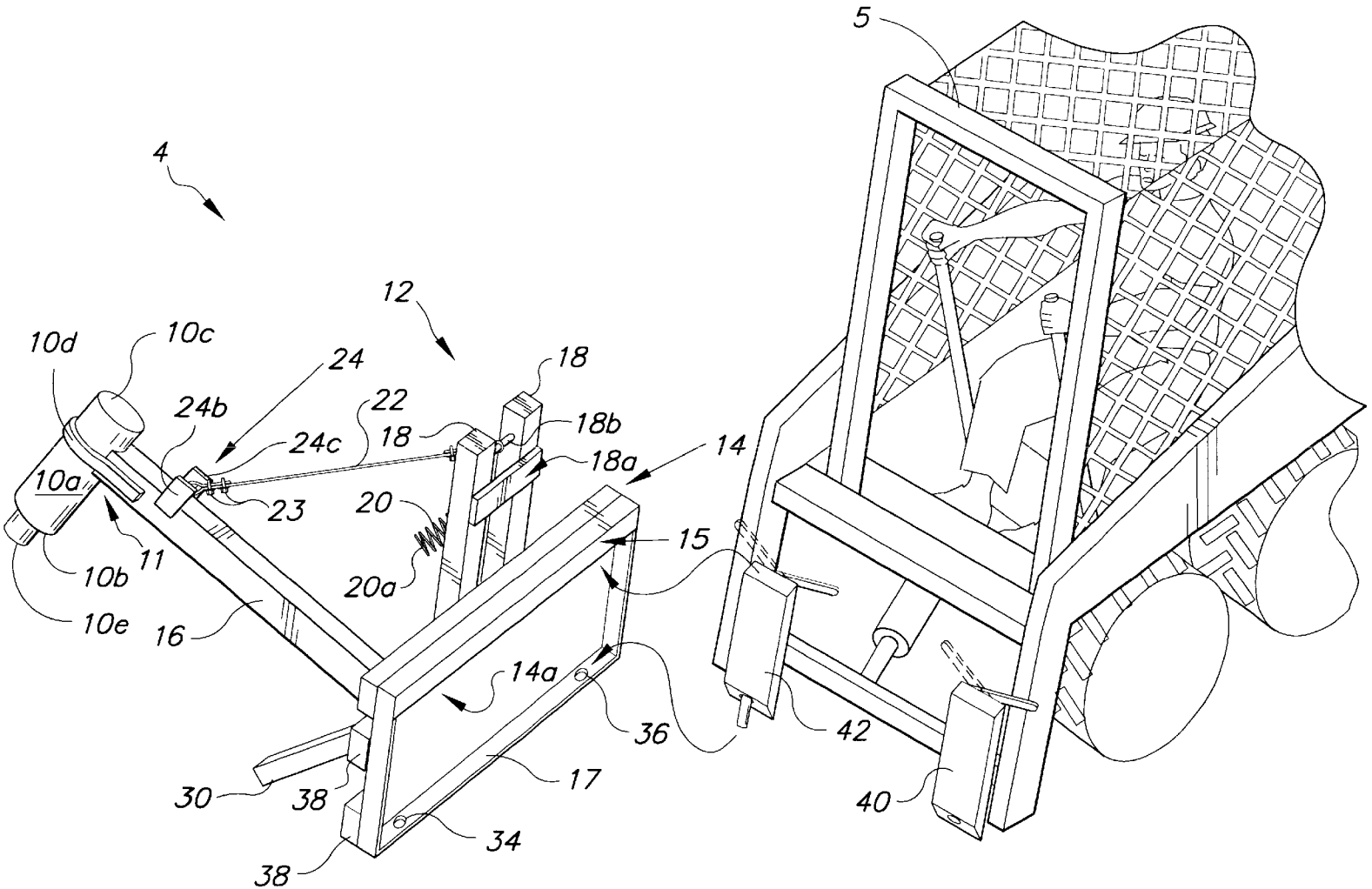
FIG. 3 is perspective sectional view of the head breaker according to the invention, illustrating separate attachment sections for connection to a skid loader.

As diagrammatically illustrated in FIGS. 1–3, the improved concrete breaker head 4 for demolishing ground materials G such as concrete, pavement, asphalt, etc. is shown in combination with a skid loader 5. The concrete head 4 comprises a counterbalanced hammer member 10, an impact support member 12 and an attachment means or face-plate 14 for attaching the hammer member 10 to the skid loader 5. The counterbalance hammer member 10 comprises a tubular support housing 10*a* having a first end 10*b*, a second end 10*c*, and a counter weight means or solid metallic material 10*d* (i.e. steel, iron, etc.) for stabilizing and balancing the moment of inertia of the hammer member 10 about a pivoting axis of rotation X. An impact head portion 10*e* is disposed via mechanical welds at the first end 10*b*, and a tubular supporting arm structure 16 is integrally disposed near the second end 10*c* in substantially orthogonal arrangement with, a side portion 11 of the housing of the hammer member 10. The support arm 16 is disposed thereto for uniformly distributing localized impact stresses from demolition therethrough.

As best seen in FIG. 2, the supporting arm structure 16 is pivotally and integrally attached to the attachment means or face-plate 14 and the impact support member 12, respectively for raising and selectively lowering the hammer member 10. The impact support member 12 comprises at least one beam member 18 having a first 20 and second 22 combination dampening and constraining means fixedly attached a predetermined distance thereto for dampening reaction impacts or mechanical vibrations from the hammer member 10 upon impact and selectively constraining the hammer member 10 thereto.

The dampening means 20 is preferably a metallic spring or coil, shaped and formed to have a predetermined stiffness constant k (N/m) thereby providing a desired degree of dampening or vibration absorption per unit distance of spring compression. Accordingly, the coil 20 is fixedly attached to an upper underside portion 18*a* of the impact support member 12 with a free end 20*a* of the coil 20 for mating engagement with a surface portion of the support arm 16.

The constraining means or cable 22 is preferably lifting cable wire varying in gauge depending on the area of application, but is preferably ⅝ inches in diameter or greater for a support arm 16 having a length around 96 inches. Each end of the lifting cable is disposed preferably around 3 inches or greater diameter of schedule number 80 pipe which is welded to brackets on or near the head end of the support arm. This particular arrangement reduces localize stresses at a single point or location thereby reducing mechanical failure and extending the life of the structure. The diameter of the support arm 16 will be sized and configured to minimize inertia imbalances about the axis of rotation X. The constraining cable 22 is mechanically secured to the impact support structure 12 via a steel attachment cylinder 18*b*. The cylinder 18*b* is fixedly attached to the impact support structure 12 via mechanical welds. The cable 22 extends from the cylinder 18*b* to an auxiliary cable support assembly 24 having a cylindrical element 24*a* disposed between first 24*b* and second 24*c* steel plates via mechanical welds. pg,10 The optimum location for the support assembly is preferebly depicted in dotted lines as 24' which provides maximum leverage or the maximum moment arm which minimizes the force necessary for lifting the support arm 16. Each plate 24*b*, 24*c* is similarly secured via mechanical welds, but to the support arm 16. The cable 22 is selectively fastened to the support assembly via mechanical fasteners 23 to prevent or absorb tension producing moment forces generated by the support arm 16. These tension forces are directed through the cable 22 when the hammer member 10 is used in areas having steep slopes or used near edges having an overhang at least. This technique also prevents overextending the hammer member 10, respectively.

Also shown in FIG. 2 is at least one inclined support strut 30 for supporting the integrally connected face-plate 14 and pivotally attached arm support 16 in a resting position when unattached to the skid loader 5. A second inclined support strut (not shown) is preferably mounted at an opposite end of the face-plate in direct alignment and symmetric relation with support strut 30. The counterbalanced hammer member 10, face-plate 14 impact member 12 form a single integrated structure which is quickly and simply releasably attached to the skid loader via a single set of latches L as clearly shown in FIG. 3. of particular note, the impact head 10*e* preferably has a narrower diameter than the support housing 10*a*, and is made of stain-less steel. For added durability, the support housing 10*a* can include a substantially asymmetric shape for distributing impact stresses or to prevent localized stress concentrations within the hammer member 10. These localized stresses have been cause for fractures or material degradation within localized areas of structures.

The counter weighting means 10*d* is formed within the housing 10*a* and contiguous with the support arm structure 16 for balancing the moment of inertia of the hammer member 10 about the pivoting axis of rotation X. As more clearly shown in FIG. 3, the improved concrete breaker head has a substantially rectangular face-plate 14 having at least one insertable cavity 14*a* within a first end 15 and a first 34 and second 36 aperture disposed in a second end 17, wherein the second 17 end is opposite the insertable cavity 14*a* formed within the first end 15 for respective attachment to the latches 40 and 42 of the skid loader 5. In addition, the face-plate 14 includes at least one substantially rectangular reinforcement plate 38 attached thereto via mechanical welds for added structural reinforcement. Other advantages of the improved concrete breaker head 4 according to invention includes wherein the concrete breaker 4 is preferably made of steel with optional coating to reduce weather laden effects such as rust, corrosion, etc (eg. stain-less steel).

It is to be understood that the present invention is not limited to the embodiment described above, but encompasses any and all embodiments within the scope of the following claims.

What is claimed is:

1. A concrete breaker head adapted for attachment to a skid loader with hydraulically activated releasable latches comprising:

a counterbalanced hammer member, an impact support member and an attachment means for attaching said hammer member to the skid loader;

the counterbalance hammer member comprises a tubular support housing having a first end and a second end, a counter weighting means for stabilizing and balancing the moment of inertia of the hammer member about a pivoting axis of rotation, an impact head portion disposed at the first end, and a tubular supporting arm structure integrally disposed near the second end in substantially orthogonal arrangement with, a side portion of the housing of said hammer member for uniformly distributing localized impact stresses therethrough, said supporting arm structure being pivotally and integrally attached to the attachment means and the impact support member, respectively for raising and selectively lowering the hammer member;

the impact support member comprises at least one beam member having a first and second combination dampening and constraining means fixedly attached thereto for dampening reaction impacts from the hammer member and constraining said hammer member thereto, the counterbalanced hammer member, attachment means and impact support member form a single integrated structure for releasable attachment with one portion of the skid loader via the attachment means, and wherein the impact support member further comprises at least one inclined support strut for supporting the integrally connected attachment means and pivotally attached supporting arm structure in a resting position when unattached to the skid loader.

2. The concrete breaker head according to claim 1, wherein the impact support member has a narrower diameter than the housing.

3. The concrete breaker head according to claim 2, wherein the counter weighting means is formed within the housing and contiguous with the supporting arm structure having a predetermined arm length for balancing the moment of inertia of the pivoting axis of rotation.

4. The concrete breaker head according to claim 1, wherein the housing, integrally attached tubular supporting arm structure and impact support member are made of steel.

5. The concrete breaker head according to claim 1, wherein said attachment means is a substantially rectangular face-plate having at least one insertable cavity within a first end and a first and second aperture disposed in a second end, wherein said second end is opposite the insertable cavity formed within the first end for respective attachment to the latches of the skid loader.

6. The concrete breaker head according to claim 5, wherein said face-plate includes at least one reinforcement plate attached thereto for structural reinforcement.

7. The concrete breaker head according to claim 6; wherein said at least one reinforcement plate is attached via mechanical welds.

8. The concrete breaker head according to claim 7, wherein said at least one reinforcement plate is substantially rectangular and is made of steel.

9. A concrete breaker head adapted for attachment to skid loaders via hydraulically activated releasable latches comprising:

a counterbalanced hammer member, an impact support member and an attachment means for attaching said hammer member to the skid loader;

the counterbalance hammer member comprises a tubular support housing having a first end and a second end, a counter weighting means for stabilizing and balancing the moment of inertia of the hammer member about a pivoting axis of rotation, an impact head portion disposed at the first end, and a tubular supporting arm structure integrally disposed near the second end in substantially orthogonal arrangement with, a side portion of the housing of said hammer member for uniformly distributing localized impact stresses therethrough, said supporting arm structure being pivotally and integrally attached to the attachment means and the impact support member, respectively for raising and selectively lowering the hammer member;

the impact support member comprises at least one beam member having a first and second combination dampening and constraining means fixedly attached thereto for dampening reaction impacts from the hammer member and constraining said hammer member thereto, the counterbalanced hammer member, attachment means and impact support member form a single integrated structure for releasable attachment with one portion of the skid loader via the attachment means;

the impact support member further comprises at least one inclined support strut for supporting the integrally connected attachment means and pivotally attached supporting arm structure in a resting position when unattached to the skid loader; and said attachment means is a substantially rectangular face-plate having at least one insertable cavity within a first end and a first and second aperture disposed in a second end, wherein said second end is opposite the insertable cavity formed within the first end for respective attachment to the latches of the skid loader.

10. The concrete breaker head according to claim 9, wherein the impact support member has a narrower diameter than the housing.

11. The concrete breaker head according to claim 10, wherein the housing is substantially asymmetric shaped member.

12. The concrete breaker head according to claim 10, wherein the counter weighting means is formed within the housing and contiguous with the supporting arm structure for balancing the moment of inertia of the pivoting axis of rotation.

13. The concrete breaker head according to claim 9, wherein the housing, integrally attached tubular supporting arm structure and impact support member are made of steel.

14. The concrete breaker head according to claim 9, wherein said face-plate includes at least one reinforcement plate attached thereto for structural reinforcement.

15. The concrete breaker head according to claim 14, wherein said at least one reinforcement plate is attached via mechanical welds.

16. The concrete breaker head according to claim 15, wherein said at least one reinforcement plate is substantially rectangular and is made of steel.

17. A concrete breaker head adapted for attachment to a skid loader with hydraulically activated releasable latches comprising, in combination with said skid loader:

a counterbalanced hammer member, an impact support member and an attachment means for attaching said hammer member to the skid loader;

the counterbalance hammer member comprises a tubular support housing having a first end and a second end, a counter weighting means for stabilizing and balancing the moment of inertia of the hammer member about a pivoting axis of rotation, an impact head portion disposed at the first end, and a tubular supporting arm structure integrally disposed near the second end in substantially orthogonal arrangement with, a side portion of the housing of said hammer member for uniformly distributing localized impact stresses therethrough, said supporting arm structure being pivotally and integrally attached to the attachment means and the impact support member, respectively for raising and selectively lowering the hammer member;

the impact support member comprises at least one beam member having a first and second combination dampening and constraining means fixedly attached thereto for dampening reaction impacts from the hammer member and constraining said hammer member thereto, the counterbalanced hammer member, attachment means and impact support member form a single integrated structure for releasable attachment with one portion of the skid loader via the attachment means, and wherein the impact support member further comprises at least one support strut for supporting the integrally connected attachment means and pivotally attached supporting arm structure in a resting position when unattached to the skid loader;

the dampening means having a coil with a free end for impact with a surface portion of the supporting arm structure.

18. The concrete breaker head according to claim 17, wherein said combination coil damper and constraining means are attached to the same of said at least one beam member in space and substantially parallel relation with respect to each other.

19. The concrete breaker head according to claim 18, wherein said constraining means is a flexible cable; said cable being mounted above the coil damper of the same of said at least on beam member.

* * * * *